US006231315B1

(12) United States Patent
Ikeda et al.

(10) Patent No.: US 6,231,315 B1
(45) **Date of Patent: *May 15, 2001**

(54) COMPRESSOR HAVING A VALUE PLATE AND A GASKET

(75) Inventors: Hayato Ikeda; Noriyuki Shintoku; Masaaki Nishimoto; Satoru Kuramoto, all of Kariya; Yasuo Takahara, Anjo, all of (JP)

(73) Assignees: Kabushiki Kaisha Toyoda Jidoshokki Seisakusho; Denso Corporation, both of Kariya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/880,372

(22) Filed: Jun. 23, 1997

(30) Foreign Application Priority Data

Jun. 24, 1996 (JP) ..... 8-163093

(51) Int. Cl.[7] ..... F04B 1/12
(52) U.S. Cl. ..... 417/269; 417/560; 137/856
(58) Field of Search ..... 417/269, 569, 417/560; 137/856; 277/628, 630, 634, 638

(56) References Cited

U.S. PATENT DOCUMENTS

| | | | | |
|---|---|---|---|---|
| 5,186,475 | | 2/1993 | Kawai et al. . | |
| 5,379,799 | * | 1/1995 | Kawai et al. | 137/856 |
| 5,466,129 | * | 11/1995 | Fukai | 417/269 |
| 5,607,287 | * | 3/1997 | Ikeda et al. | 417/569 |

* cited by examiner

*Primary Examiner*—Charles G. Freay
(74) *Attorney, Agent, or Firm*—Morgan & Finnegan, LLP

(57) ABSTRACT

A compressor includes a cylinder block and a housing connected to the ends of the cylinder block. A suction chamber and a discharge chamber are defined in the housing, respectively, and the chambers are divided by a bulkhead, or wall. A valve plate, which has a discharge port for connecting the cylinder bores with the discharge chamber, is positioned between the cylinder block and the housing. A discharge valve is provided for selectively opening and closing the discharge port. A gasket is positioned between the housing and the valve plate, and the gasket is held to the bulkhead. The gasket has a bulkhead seal portion, which is between the bulkhead and the valve plate for sealing between the discharge chamber and the suction chamber, and a protruding portion, which protrudes radially beyond the bulkhead, extending along and contacting the valve plate.

13 Claims, 5 Drawing Sheets

COMPRESSOR HAVING A VALUE PLATE AND A GASKET

BACKGROUND OF THE INVENTION

1. Field of the Invention

The present invention generally relates to compressors, and more particularly, to an improved gasket for sealing between compression and suction chambers in a compressor.

2. Description of the Related Art

Typical compressors include a cylinder block having a plurality of cylinder bores defined therein. A piston is accommodated in and reciprocates with respect to each cylinder bore. Front and rear housings are secured to the front and rear end faces of the cylinder block with a valve plate in between, respectively. Each housing includes a bulkhead formed therein. Each housing, the associated valve plate and the cylinder block define suction and discharge chambers. Suction and discharge valve mechanisms are formed on both sides of the valve plate. The suction and discharge mechanisms correspond to the suction and discharge chamber, respectively.

A compressor of the above structure includes, for example, a discharge valve mechanism as illustrated in FIG. 6. A first plate 43 and a gasket 44 are located between a valve plate 41 and a housing 42. A plurality of discharge port 45 (only one is shown) are formed in the valve plate 41, each corresponding to one of the cylinder bores. A plurality of discharge valve flaps 43*a* are formed on the first plate 43. Each flap 43*a* corresponds to one of the valve port 45. Each flap 43*a* selectively opens and closes the corresponding port 45.

The gasket 44 includes an annular seal 44*a* (see FIGS. 5 and 6) the width of which is substantially the same as that of a bulkhead 42*a* of the housing 42. The seal 44*a* is held between the distal end of the bulkhead 42*a* and the valve plate 41 thereby sealing a suction chamber 46 defined in the housing 42 from a discharge chamber 47 defined in the housing 42.

The gasket 44 also includes retainers 44*b* integrally formed with the seal 44*a*. Each retainer 44*b* defines the opening amount of the corresponding discharge valve flap 43*a*. When highly pressurized refrigerant gas is discharge to the discharge chamber 47, the gas causes the associated discharge valve flap 43*a* to flex to an open position, which is defined by the retainer 44*b*. The force of the refrigerant gas pushes the inner wall of the discharge chamber 47 in a direction away from the valve plate 41. If the contact pressure of the valve plate 41 and the distal end face of the bulkhead 42*a* with the seal 44*a* in between is not great enough, the force of the gas partly separates the seal 44*a* from the valve plate 41. This deteriorates the sealing between the suction chamber 46 and the discharge chamber 47 and causes compressed gas in the discharge chamber 47 to leak into the suction chamber 46. The compression efficiency of the compressor in thus reduced.

Since the retainer 44*b* and the seal 44*a* are integrally formed, refrigerant gas discharged to the discharge chamber 47 presses each discharge valve flap 43*a* against the corresponding retainer 44*b* with a great force. As shown in FIG. 7, a force f1 acting on the retainer 44*b* generates an angular moment M0 the center of which is a contact point A0 of the inner edge of the bulkhead 42*a* and the seal 44*a* of the gasket 44. A reactive force f0 is generated at the contact point B0 of the valve plate 41 and the outer edge of the seal 44*a* in accordance with the angular moment M0. A resultant force f1+f0 is generated at the contact point A0. The force f1+f0 pushes the bulkhead 42*a* away from the valve plate 41.

Since the width of the seal 44*a* is substantially the same an that of the bulkhead 42*a,* the center A0 of the angular moment M0 is relatively close to the point of application B0 or the reactive force f0. The shorter the distance between the center A0 of the moment and the reactive force f0, the greater the magnitude of the reactive force f0 becomes. If the reactive force f0 is increased, the force f1+f0, which pushes the housing 42 away from the valve plate 41, is increased, accordingly. Thus the housing 42 becomes more likely to separate from the valve plate 41.

SUMMARY OF THE INVENTION

Accordingly, it is an objective of the present invention to provide a compressor that improves sealing between chambers having different pressures.

To achieve the above objective, the present invention provides a compressor. The compressor includes a cylinder block and a housing connected to the ends of the cylinder block. A first gas chamber and a second gas chamber are defined in the housing, respectively, and the chambers are divided by a bulkhead. A valve plate, which has a first port for connecting the cylinder bores with the discharge chamber, is positioned between the cylinder block and the housing. A valve is provided for selectively opening and closing the first port. A gasket is positioned between the housing and the valve plate, and the gasket is held to the bulkhead. The gasket has a bulkhead seal portion, which is between the bulkhead and the valve plate for sealing between the first gas chamber and the second gas chamber, and a protruding portion, which protrudes radially beyond the bulkhead, extending along and contacting the valve plate.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A swash plate type compressor having double-headed pistons according to the present invention will now be described with reference to FIGS. 1 to 4.

Figure 2:
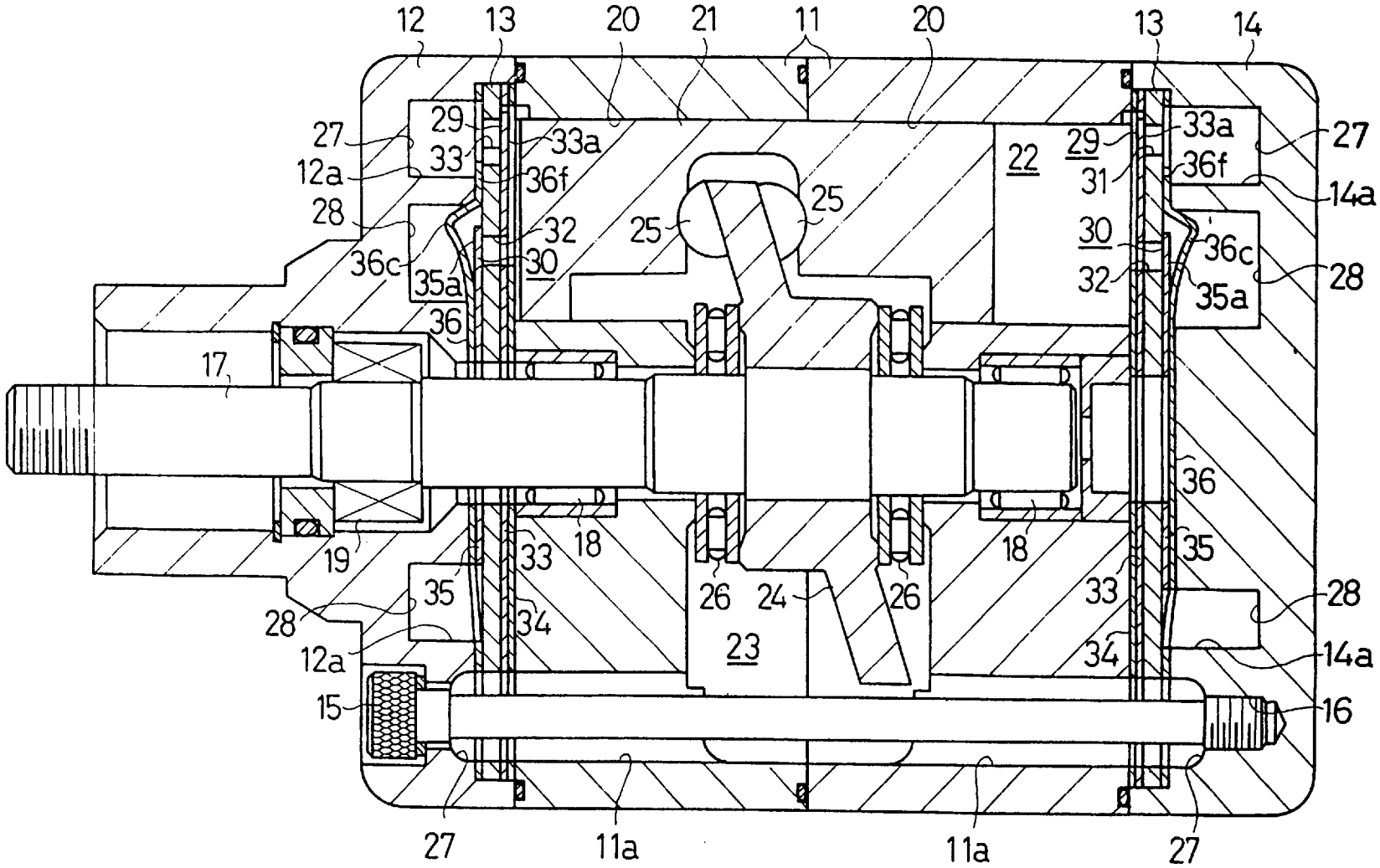
FIG. 2 is a cross-sectional view illustrating a compressor.

As shown in FIG. 2, a pair of cylinder blocks 11 are secured to each other at their ends. A front housing 12 is secured to the front end face of the front cylinder block 11 with a valve plate 13 in between. A rear housing 14 is secured to the rear end face of the rear cylinder block 11 with a valve plate 13 in between. The cylinder blocks 11 and the front and rear housings 12, 14 are made of aluminum or aluminum alloy.

A plurality of bolts 15 extend through the front housing 12, cylinder blocks 11 and the valve plates 13 and are threaded in screw holes 16 formed in the rear housing 14. The bolts 15 secure the front and rear housings 12, 14 to the front and rear faces of the cylinder blocks 11 with a metal valve plate 13 in between, respectively.

A rotary shaft 17 is rotatably supported in the center of the cylinder blocks 11 and the front housing 12 with a pair of radial bearings 18. A lip seal 19 is located between the rotary shaft 17 and the front housing 12. The rotary shaft 17 is connected to and rotated by an external power source such as a vehicle engine (not shown).

A plurality of aligned pairs of cylinder bores 20 are defined in the cylinder blocks 11 such that the rotary shaft 17 is located centrally with respect to the bores 20. A double-headed piston 21 is housed in and reciprocates with respect to each pair of cylinder bores 20. Compression chambers 22 are defined by the heads of a set of pistons 21 and the associated valve plate 13 in each cylinder bore 20.

A crank chamber 23 is defined between the cylinder blocks 11. A swash plate 24 is fixed to the rotary shaft 17 and is located in the crank chamber 23. The swash plate 24 is also coupled to the central part of each piston 21 with a pair of semispherical shoes 25. The swash plate 24 is rotated by the rotary shaft 17. The rotation of the swash plate 24 is then transmitted to the pistons 21 through the shoes 25 and is converted into linear reciprocation of each piston 21. A pair of thrust bearings 26 are located between an inner wall of each cylinder block 11 and the swash plate 24, respectively.

Bulkheads 12*a* and 14*a* are formed in the housings 12 and 14, respectively. A suction chamber 27 and a discharge chamber 28 are defined by the bulkheads 12*a*, 14*a* in the radially outer portion and inner portions of the housings 12, 14, respectively. The suction chambers 27 are communicated with the crank chamber 23 via suction passages 11*a* defined in the cylinder blocks 11 and the valve plates 13. The crank chamber 23 is connected to an external refrigerant circuit via an inlet port (not shown). The discharge chambers 28 are connected to the refrigerant circuit via a discharge muffler and an outlet (both not shown).

A suction valve mechanism 29 is formed on the cylinder block side of each valve plate 13. The mechanism 29 allows the reciprocation of each piston 21 to draw refrigerant gas from the suction chamber 27 into each compression chamber 22. A discharge valve mechanism 30 is formed on an outer side of each valve plate 13. The mechanism 30 allows the reciprocation of each piston 21 to discharge refrigerant gas that is compressed in the corresponding compression chamber 22 to the discharge chamber 28.

The construction of the suction valve mechanisms 29 and the discharge valve mechanisms 30 will hereafter be described with reference to FIGS. 1 to 3. Each valve plate 13 has a plurality of suction ports 31 and discharge ports 32. Each suction port 31 and each discharge port 32 correspond to one of the cylinder bores 20. A first metal plate 33 and a metal gasket 34 are located between each valve plate 13 and the corresponding cylinder block 11. Both sides of the gasket 34 are coated with rubber. Each first plate 33 has a plurality of suction valve flaps 33*a*. Each flap 33*a* selectively opens and closes the corresponding suction port 31.

A second metal plate 35 and a metal gasket 36, which also functions as a retainer, are located between the housings 12, 14 and the corresponding valve plate 13. Both sides of the gasket 36 are coated with rubber. Each second plate 35 has a plurality of discharge valve flaps 35*a*. Each flap 35*a* selectively opens and closes the corresponding discharge port 32.

Figure 1:
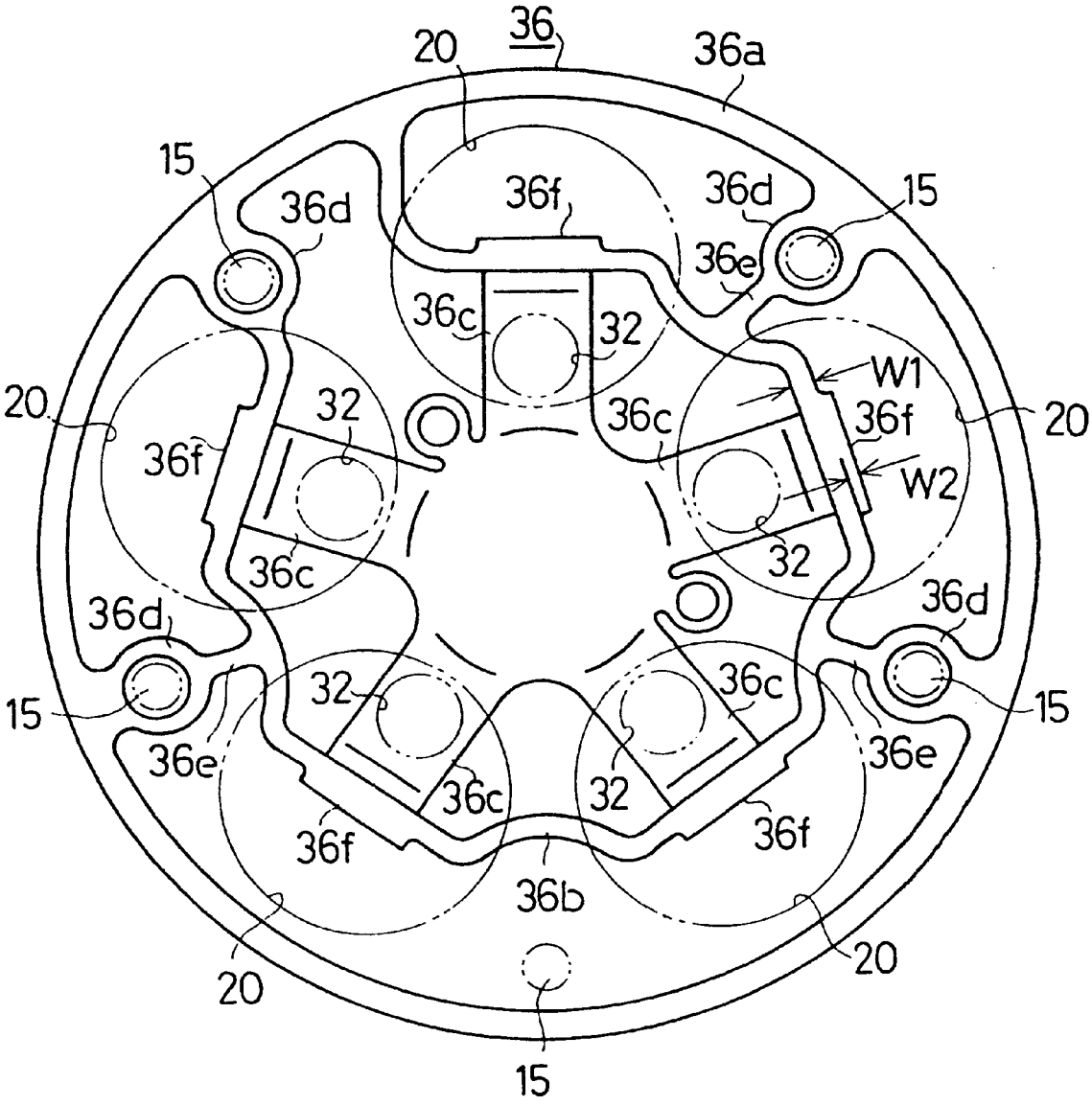
FIG. 1 is a plan view illustrating a gasket according to the present invention, which also functions an a retainer plate.

As shown in FIG. 1, the gasket 36 includes an annular outer seal 36*a*, an annular inner seal 36*b*, a plurality of retainers 36*c*. Each retainer 36*c* defines the opening of one of discharge valve flaps 35*a*. A plurality of hole portions 36*d*, through which the bolts 15 are inserted, are formed between the outer seal 36*a* and the inner seals 36*b*. The inner seal 36*b* is connected to the hole portions 36*d* and the outer seal 36*a* by a plurality of connectors 36*e*.

The width of the inner seal 36*b* is substantially the same as that of the bulkheads 12*a*, 14*a* of the housing 12, 14. The inner seal 36*b* of each gasket 36 is located between the bulkheads 12*a*, 14*a* and the corresponding valve plate 13. Each inner seal 36*b* seals between the corresponding suction chamber 27 and the discharge chamber 28.

The gasket 36 has a plurality of protrusions 36*f*, each of which radially protrudes outward from the inner seal 36*b*. As shown in FIGS. 3 and 4, the protrusions 36*f* protrude from the edge of the bulkheads 12*a*, 14*a* into the suction chamber 27. In this embodiment, the gasket 36 is 0.8 mm thick end the inner seal 36*b* is 4 mm wide. In a gasket of this size, the width of the protrusion 36*f* is preferably at least 0.5 mm. In this embodiment, the protrusions 36*f* are 2 mm wide.

The operation of the compressor of FIG. 2 will hereafter be described.

When rotated by an external power source such as an engine, the rotary shaft 17 causes the swash plate 24 to rotate together. The rotation of the swash plate 24 is converted into linear reciprocation of each piston 21 in the associated cylinder bore 20 by the shoes 25. The reciprocation of each piston 21 causes refrigerant gas in an external refrigerant circuit to be drawn into the crank chamber 23 and then drawn into the suction chambers 27 through the suction passages 11*a*. As each piston 21 moves from the top dead center to the bottom dead center, refrigerant gas in the suction chamber 27 is drawn into each cylinder bore 20 while causing the associated suction valve flap 33*a* to flex to an open position. As each piston 21 moves from the bottom dead center to the top dead center, refrigerant gas is compressed in the cylinder bore 20 until it reaches a certain pressure level. The compressed gas is then discharged to the discharge chamber 28 while causing the associated discharge valve flap 35*a* to flex to an open position. Refrigerant gas in the discharge chambers 28 is supplied to the external refrigerant circuit via a discharge muffler and a outlet part (both not shown).

Figure 3:
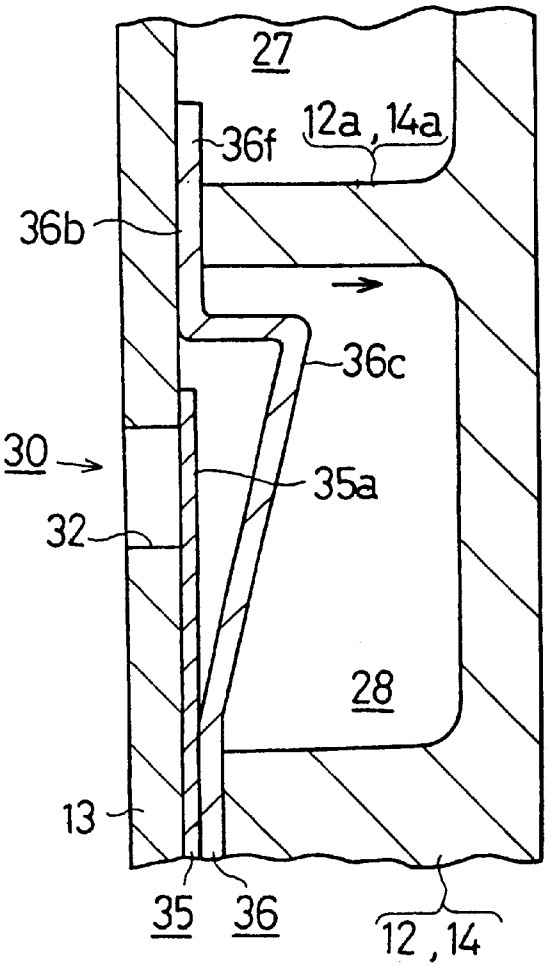
FIG. 3 is an enlarged partial cross-sectional view illustrating a portion of the compressor of FIG. 2.
Figure 4:
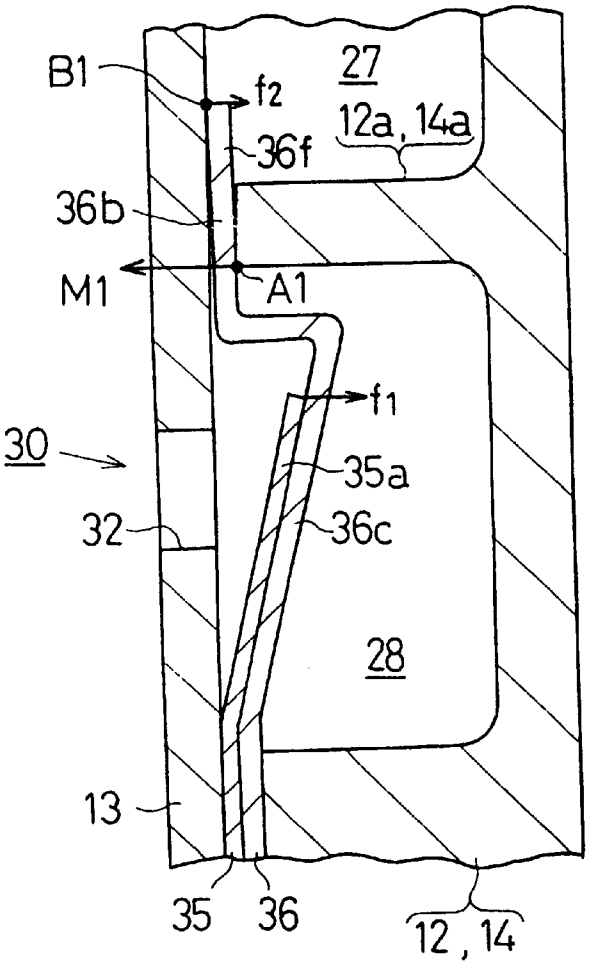
FIG. 4 is an enlarged partial cross-sectional view illustrating a portion of the compressor of FIG. 2 when a discharge port is open.
Figure 5:
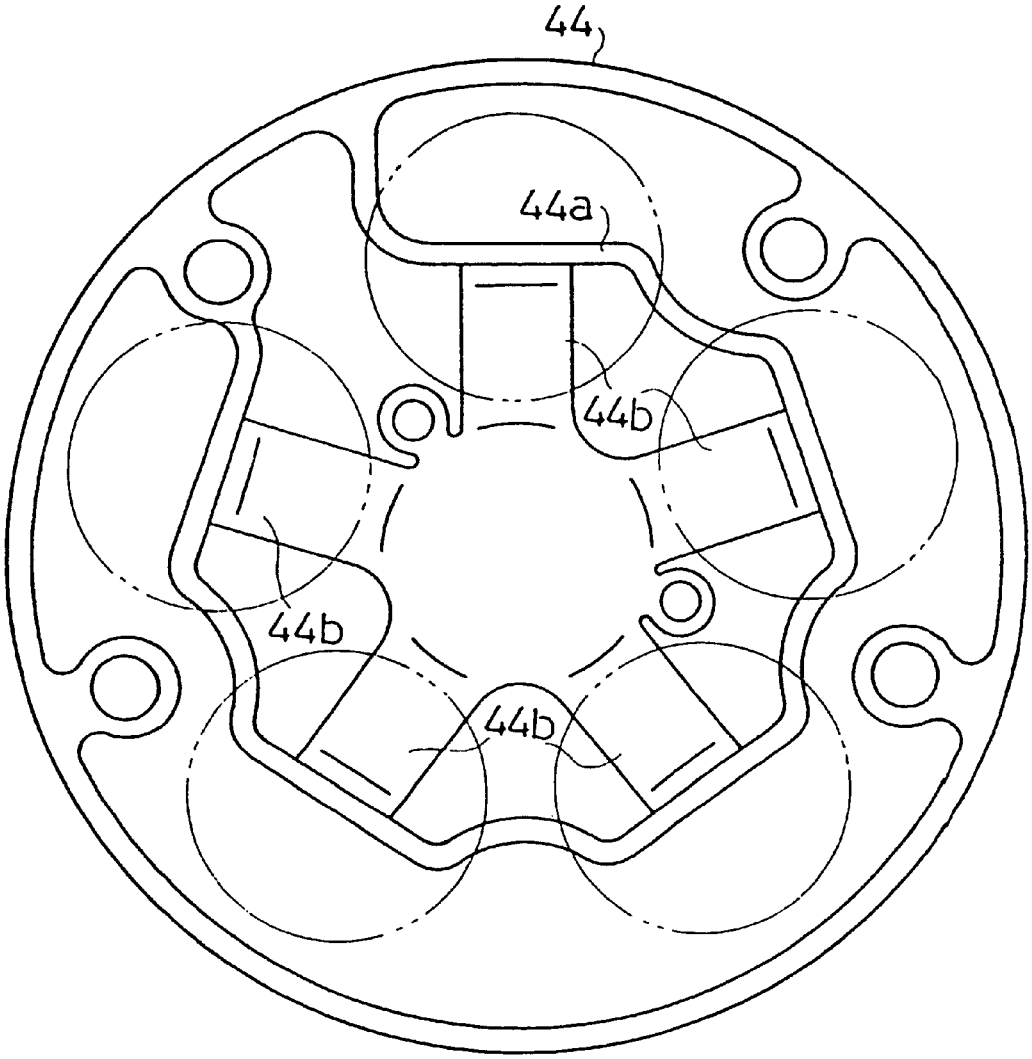
Fig.5 (Prior Art)
FIG. 5 is a plan view illustrating a prior art gasket.
Figure 6:
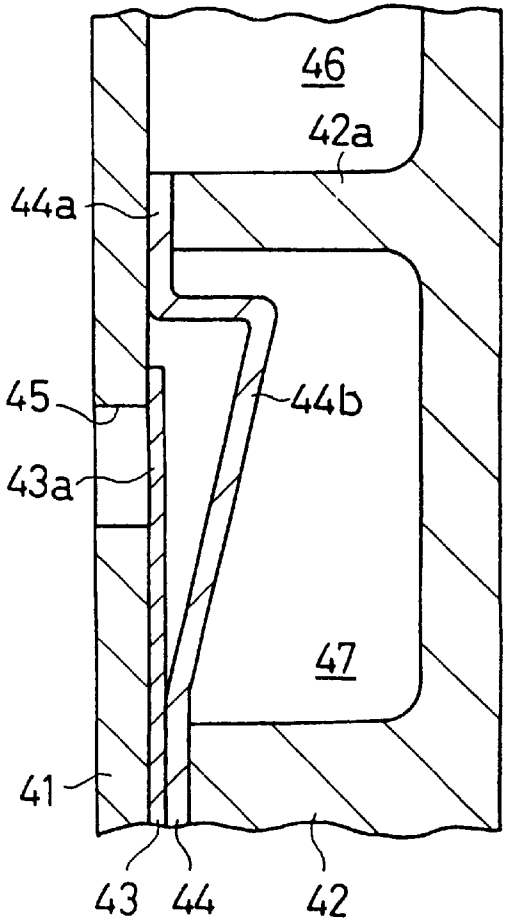
Fig.6 (Prior Art)
FIG. 6 is an enlarged partial cross-sectional view illustrating a prior art compressor.
Figure 7:
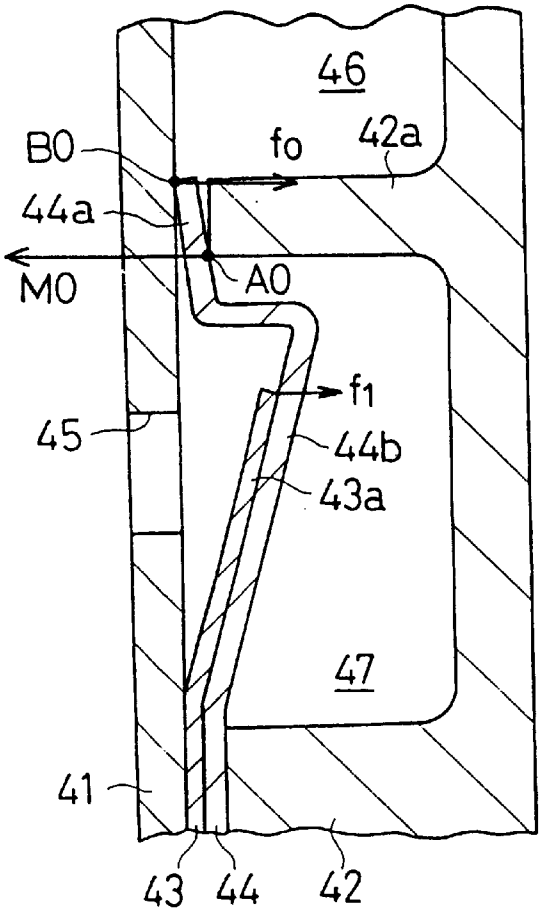
Fig.7 (Prior Art)
FIG. 7 is an enlarged partial cross-sectional view illustrating the compressor of FIG. 6 when a discharge valve is open.

A high pressure in the suction chamber 28 pushes the inner wall of the discharge chambers 28 in the front housing 12 and the rear housing 14 in a direction illustrated by an arrow in FIG. 3, or away from the valve plate 13.

Highly pressurized refrigerant gas that is compressed in each cylinder bore 20 is quickly discharged to the discharge chamber 28 through the discharge ports 32 when the valve flap 35*a* are opened. The discharged gas is sprayed on the inner wall of the discharge chamber 28 near the discharge port 32 and deforms the bulkheads 12*a*, 14*a* of the discharge ports 32.

Further, in the embodiment of FIG. 1, the fastening force of the bolts 15 is weakest at points along the inner seal 36 that are located about midway between each adjacent pair of the bolts 15. At these points, the bulkheads 12*a*, 14*a* of the housings 12, 14 are also relatively flexible.

Because of the above listed factors, a higher pressure in the discharge chamber 28 lowers the contact pressure between the distal ends of the bulkheads 12*a*, 14*a* and the inner seals 36*b* and the contact pressure between the valve plates 13 and the inner seals 36*b*. In these low contact pressure areas, some part of each inner seal 36*b* is separated from the valve plate 13. This reduces the contact area between the inner seal 36*b* and the valve plate 13. This deteriorates the sealing between the suction chambers 27 and the discharge chambers 28.

However, in this embodiment, the protrusions 36*f* are formed on the inner seal 36*b*. This improves the rigidity in the radial direction of the parts of the inner seal 36*b* having the protrusions 36*f*. Thus, deformation of the inner seal 36*b* is reduced and the contact pressure between the inner seal 36*b* and the valve plate 13 is improved.

When the pressure in the discharge chambers 28 is high, the high pressure expands the entire discharge chamber 28. The bulkheads 12*a*, 14*a* are deformed outward. In this embodiment, however, the contact area between the gasket 36 and the valve plate 13 is enlarged by the protrusions 36*f*. Thus, the protrusions 36*f* maintain contact with the valve plate 13 and the sealing between the suction chambers 27 and the discharge chambers 28 is improved.

Also, as shown in FIG. 4, when the valve flap 35*a* is opened, discharged refrigerant gas applies a force f1 to the retainer 36*c*. Since the retainer 36*c* is integrally formed with the inner seal 36*b*, the force f1 acts on the inner seal 36*b* and the protrusion 36*f*. The force f1 generates an angular moment M1, the center of which is a contact point A1 of the inner edge of the bulkheads 12*a*, 14*a* and the inner seal 36*b*. In accordance with the angular moment M1, a reactive force f2 is generated at the contact point B1 of the valve plate 13 and the outer edge of the protrusions 36*f*. The resultant force f1+f2 pushes the bulkhead 12*a*, 14*a* away from the valve plate 13.

However, the protrusion 36*f* increases the distance between the point M1, which is the center of the angular moment M1, and the point B1, at which the force f2 is produced by the angular moment M1, by the width of the protrusion 36*f*. According to the principles of the leverage, if the force f1 is constant, the longer the distance between the fulcrum B1 and the point of application A1 is, the weaker the force f2 becomes. Thus, a longer distance between the points A1 and B1 decreases the magnitude of the resultant force f1+f2. Accordingly, the contact area between the bulkheads 12*a*, 14*a* and the inner seal 36*b* and the contact area between inner seal 36*b* and the valve plate 13 are enlarged. This improves the sealing between the suction chambers 27 and the discharge chambers 28.

The protrusions 36*f* are formed on the inner seal 36*b* midway between the adjacent bolts 15. In other words the protrusions 36*f* correspond to parts of the bulkheads 12*a*, 14*a* that are relatively flexible and more likely to separate from the valve plate 13. Thus, the protrusions 36*f* improve the sealing between the suction chambers 27 and the discharge chambers 28.

Although only one embodiment of the present invention has been described so far, it should be apparent to those skilled in the art that the present invention may be embodied in many other specific forms without departing from the spirit or scope of the invention. Particularly, it should be understood that the invention may be embodied in the following forms.

(1) The protrusions 36*f* may be formed along the whole inner seal 36*b*. This structure further improves the sealing between the suction chamber 27 and the discharge chamber 28.

(2) Unlike the above embodiments, the suction chamber 27 may be formed in the radially inner portion of the housings 12, 14, and the discharge chamber 28 may be formed in the radially outer portion of the housings 12, 14.

(3) The present invention may be embodied in other types of compressors such an wave cam plate type compressors employing double-headed pistons, single headed-piston type compressors, and vane-type compressors.

Therefore, the present examples and embodiments are to be considered as illustrative and not restrictive and the invention is not to be limited to the details given herein, but may be modified within the scope and equivalence of the appended claims.

What is claimed is:

1. A compressor comprising:

a housing;

a cylinder block joined to the housing;

a plurality of cylinder bores defined in the cylinder block;

a drive shaft rotatably supported by the cylinder block;

a compression means for compressing gas supplied to the cylinder bores based on the rotation of the drive shaft;

a first gas chamber defined in the housing;

a second gas chamber defined in the housing the second gas chamber located adjacent to the first gas chamber;

a bulkhead for separating the first gas chamber from the second gas chamber;

a valve plate located between the cylinder block and the housing, the valve plate having a first port for each cylinder bore to communicate the associated cylinder bore with the first gas chamber, wherein the valve plate extends generally perpendicular to the bulkhead; and a retainer for restricting the opening position of the valve; and a gasket positioned between the housing and the valve plate, the gasket having a bulkhead seal portion located between the bulkhead and the valve plate for sealing between the first gas chamber and the second gas chamber, wherein the gasket has a plurality of protruding portions joined to the bulkhead seal portion and extending radially beyond the bulkhead and generally parallel to the valve plate so that the protruding portions make sealing contact with the valve plate, and each of the protruding portions being located at a position corresponding to the first port, and each of the protruding portions being spaced from one another by a predetermined distance in the circumferential direction.

2. The compressor according to claim 1, wherein said bulkhead seal portion, said retainer, and the plurality of protruding portions are integrally formed parts of the gasket.

3. The compressor according to claim 1, wherein a plurality of bolts join the housing to the valve plate, and wherein the plurality of protruding portions are located approximately midway between adjacent bolts.

4. The compressor according to claim 1, wherein the pressure in the first gas chamber is higher than the pressure in the second gas chamber, and wherein the plurality of protruding portions extend into the second gas chamber.

5. The compressor according to claim 1, wherein the valve plate has a second port for communicating the second gas chamber with the cylinder bores, the second gas chamber is a suction chamber, and the first gas chamber is a discharge chamber.

6. The compressor according to claim 1, wherein the plurality of protruding portions extend in a generally radial direction with respect to the axis of the drive shaft and have a thickness dimension, which extend in the axial direction of the drive shaft.

7. The compressor according to claim 2, wherein said gasket has a ring-like shape, and wherein the gasket is held to the cylinder by a plurality of bolts including an adjacent pair of bolts, and wherein the plurality of protruding portions are positioned at substantially midway between the adjacent pair of bolts.

8. A compressor comprising:

a housing;

a cylinder block joined to the housing;

a plurality of cylinder bores defined in the cylinder block;

a drive shaft rotatably supported by the cylinder block;

a compression means for compressing gas supplied to the cylinder bores based on the rotation of the drive shaft;

a first gas chamber defined in the housing;

a second gas chamber defined in the housing the second gas chamber located adjacent to the first gas chamber;

a bulkhead for separating the first gas chamber from the second gas chamber;

a valve plate located between the cylinder block and the housing, the valve plate having a first port for each cylinder bore to communicate the associated cylinder bore with the first gas chamber, wherein the valve plate extends generally perpendicular to the bulkhead and radially with respect to the drive shaft; and a retainer for restricting the opening position of the valve; and a gasket positioned between the housing and the valve plate and being integral with the retainer, the gasket having a bulkhead seal portion located between the bulkhead and the valve plate for sealing between the first gas chamber and the second gas chamber wherein the gasket further has a plurality of protruding portions joined to the bulkhead seal portion and extending radially beyond the bulkhead by and generally parallel to the valve plate so that the protruding portions make sealing contact with the valve plate, and each of the protruding portions being located at a position corresponding to the first port, and each of the protruding portions being spaced from one another by a predetermined distance in the circumferential direction.

9. The compressor according to claim 8, wherein the plurality of protruding portions extend at least 0.5 mm in the radial direction.

10. A compressor comprising:

a housing;

a cylinder block joined to the housing;

a plurality of cylinder bores defined in the cylinder block;

a drive shaft rotatably supported by the cylinder block;

a compression means for compressing gas supplied to the cylinder bores based on the rotation of the drive shaft;

a first gas chamber defined in the housing;

a second gas chamber defined in the housing the second gas chamber located adjacent to the first gas chamber;

a bulkhead for separating the first gas chamber from the second gas chamber;

a valve plate located between the cylinder block and the housing, the valve plate having a first port, for each cylinder bore to communicate the associated cylinder bore with the first gas chamber, wherein the valve plate extends generally perpendicular to the bulkhead; and a retainer for restricting the opening position of the valve;

a gasket positioned between the housing and the valve plate, the gasket having a bulkhead seal portion located between the bulkhead and the valve plate for sealing between the first gas chamber and the second gas chamber, the gasket further having an outer seal portion entirely surrounding the bulkhead seal portion and a plurality of connectors located between the outer seal portion and the bulkhead seal portion to connect the bulkhead seal portion to the outer seal portion, each of the connectors having a hole through which a fastener joining the housing, the valve plate, and the cylinder block together is inserted, the gasket further having a plurality of protruding portions positioned between the adjacent pair of the connectors, wherein the protruding portions are joined to the bulkhead seal portion and extend beyond the bulkhead and generally parallel to the valve plate so that the protruding portions make sealing contact with the valve plate.

11. The compressor according to claim 10, wherein the plurality of protruding portions extend approximately 2 mm in the radial direction.

12. A compressor comprising:

a housing;

a cylinder block joined to the housing;

a plurality of cylinder bores defined in the cylinder block;

a drive shaft rotatably supported by the cylinder block;

a compression means for compressing gas supplied to the cylinder bores based on the rotation of the drive shaft;

a first gas chamber defined in the housing;

a second gas chamber defined in the housing the second gas chamber located adjacent to the first gas chamber;

a bulkhead for separating the first gas chamber from the second gas chamber;

a valve plate located between the cylinder block and the housing, the valve plate having a first port, for each cylinder bore to communicate the associated cylinder bore with the first gas chamber, wherein the valve plate extends generally perpendicular to the bulkhead and radially with respect to the drive shaft;

a retainer for restricting the opening position of the valve; and a gasket positioned between the housing and the valve plate and being integral with the retainer, the gasket having a bulkhead seal portion located between the bulkhead and the valve plate for sealing between the first gas chamber and the second gas chamber, the gasket further having an outer seal portion entirely surrounding the bulkhead seal portion and a plurality of connectors located between the outer seal portion and the bulkhead seal portion to connect the bulkhead seal portion to the outer seal portion, each of the connectors having a hole through which a fastener joining the housing, the valve plate, and the cylinder block together is inserted, the gasket further having a plurality of protruding portions positioned between the adjacent pair of the connectors, wherein the protruding portions are joined to the bulkhead seal portion and extend radially beyond the bulkhead and generally parallel to the valve plate so that the protruding portions make sealing contact with the valve plate.

13. A compressor comprising:

a housing;

a cylinder block joined to the housing;

a plurality of cylinder bores defined in the cylinder block;

a drive shaft rotatably supported by the cylinder block;

a compression means for compressing gas supplied to the cylinder bores based on the rotation of the drive shaft;

a first gas chamber defined in the housing;

a second gas chamber defined in the housing the second gas chamber located adjacent to the first gas chamber;

a bulkhead for separating the first gas chamber from the second gas chamber;

a valve plate located between the cylinder block and the housing, the valve plate having a first port, for each cylinder bore to communicate the associated cylinder bore with the first gas chamber, wherein the valve plate extends generally perpendicular to the bulkhead;

a retainer for restricting the opening position of the valve; and a gasket positioned between the housing and the valve plate, the gasket having a bulkhead seat portion located between the bulkhead and the valve plate for sealing between the first gas chamber and the second gas chamber, the bulkhead seal portion having a plurality of connectors, each connector extends radially outward from the bulkhead seal portion, the gasket further having an outer seal portion entirely surrounding the bulkhead seal portion and a plurality of hole portions having a hole through which a fastener joining the housing, the valve plate, and the cylinder block together is inserted, each hole portion extends radially inward from the outer seal portion towards an associated connector, the bulkhead seal portion is connected to the outer seal portion by connecting each hole portion to the associated connector, the gasket further having a plurality of protruding portions positioned between the adjacent pair of the fasteners, wherein the protruding portions are joined to the bulkhead seal portion and extend beyond the bulkhead and generally parallel to the valve plate so that the protruding portions make sealing contact with the valve plate.

* * * * *

UNITED STATES PATENT AND TRADEMARK OFFICE

CERTIFICATE OF CORRECTION

PATENT NO. : 6,231,315 B1
DATED : May 15, 2001
INVENTOR(S) : Hayato Ikeda et al.

It is certified that error appears in the above-identified patent and that said Letters Patent is hereby corrected as shown below:

Column 2,
Line 4, please change "an" to -- as --;
Line 48, please change "an" to -- as --;

Column 4,
Line 28, please change "end" to -- and --;

Column 9,
Line 23, please change "seat" to -- seal --.

Signed and Sealed this

Twenty-sixth Day of March, 2002

*Attest:*

*Attesting Officer*

JAMES E. ROGAN
*Director of the United States Patent and Trademark Office*